US009744553B2

(12) United States Patent
Fort et al.

(10) Patent No.: US 9,744,553 B2
(45) Date of Patent: Aug. 29, 2017

(54) COOLED HOT MELT ADHESIVE STORAGE SYSTEMS, AND RELATED METHODS

(71) Applicant: Nordson Corporation, Westlake, OH (US)

(72) Inventors: Wesley C. Fort, Cumming, GA (US); Laurence B. Saidman, Duluth, GA (US); Sang Hyub Shin, Duluth, GA (US); Raymond L. Townsend, Johnstown, CO (US); Leslie J. Varga, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 280 days.

(21) Appl. No.: 14/524,457

(22) Filed: Oct. 27, 2014

(65) Prior Publication Data

US 2015/0114989 A1 Apr. 30, 2015

Related U.S. Application Data

(60) Provisional application No. 61/897,486, filed on Oct. 30, 2013.

(51) Int. Cl.
*F25D 17/00* (2006.01)
*B05C 11/10* (2006.01)

(52) U.S. Cl.
CPC ..... *B05C 11/1047* (2013.01); *B05C 11/1042* (2013.01)

(58) Field of Classification Search
CPC ..... B05C 11/1047; B05C 11/1042
See application file for complete search history.

(56) References Cited

U.S. PATENT DOCUMENTS 3,981,416 A * 9/1976 Scholl ..... F04C 13/002 222/146.1
4,545,504 A * 10/1985 Fabel ..... B05C 11/1042 219/388
5,149,266 A * 9/1992 Heinemann ..... F27D 9/00 110/288
2013/0115016 A1* 5/2013 Ross ..... B65G 51/00 406/127
2014/0119842 A1 5/2014 Jeter

OTHER PUBLICATIONS

Nordson Corporation, Fillmaster™ Adhesive Feed System, Brochure, 2 pgs., 2002.

* cited by examiner

*Primary Examiner* — Frantz Jules
*Assistant Examiner* — Steve Tanenbaum
(74) *Attorney, Agent, or Firm* — Baker & Hostetler LLP

(57) ABSTRACT

A cooled hot melt adhesive material storage system includes a bin and a cooling unit. The bin receives and holds a supply of hot melt adhesive pieces, and includes an outlet for communicating hot melt adhesive pieces to a melter device. The cooling unit is operatively coupled with the bin, and is configured for cooling hot melt adhesive pieces contained in the bin.

23 Claims, 2 Drawing Sheets

COOLED HOT MELT ADHESIVE STORAGE SYSTEMS, AND RELATED METHODS

CROSS-REFERENCE TO RELATED APPLICATION

This application claims the benefit of Application Ser. No. 61/897,486, filed Oct. 30, 2013, the disclosure of which is hereby incorporated by reference herein.

FIELD OF THE INVENTION

The present invention generally relates to hot melt adhesive systems, and more particularly to systems for storing unmelted hot melt adhesive pieces.

BACKGROUND

Hot melt adhesive systems have many applications in manufacturing and packaging. For example, thermoplastic hot melt adhesives are used for carton sealing, case sealing, tray forming, pallet stabilization, nonwoven applications including diaper manufacturing, and many other applications. Hot melt adhesives often come in the form of pellets or particulates, which are generally referred to as pieces, and are contained in or provided from an adhesive supply to a melter device, where the pieces are melted into a liquid hot melt adhesive material. The liquid hot melt adhesive material can them be pumped to a dispenser, such as a dispensing gun or other applicator which applies the hot melt adhesive to a substrate. Hot melt adhesive, in its pre-melted state (referred to herein as hot melt adhesive pieces, or unmelted hot melt adhesive pieces), can be provided in a variety of shapes and sizes, ranging from small bb-sized pieces, to larger sized pieces which are sometimes referred to as "chips" and still larger "pillows" that are several inches in dimension. Hot melt adhesive pieces may be moved from the adhesive supply to the melter as part of an automated filling operation.

For example, air-driven, or pneumatic, transfer systems use the force of flowing air to move hot melt adhesive pieces from an adhesive supply to a melter. In a known arrangement, a transfer conduit connects the adhesive supply with the melter, and an air pump is operated to generate an air flow that moves hot melt adhesive pieces through the transfer hose from the adhesive supply to the melter.

Environmental conditions, however, can interfere with the movement of hot melt adhesive pieces from the adhesive supply to the melter. For example, as the environmental temperature increases, the hot melt adhesive pieces can begin to soften and stick together to form clumps of hot melt adhesive.

Pneumatic transfer systems have a limit relative to the size and weight of the hot melt adhesive that they can transfer in a cost effective manner. Large clumps of hot melt adhesive can be too large to fit through a transfer hose and travel between the adhesive supply and the melter. Large clumps can also be too heavy to be moved by a given pneumatic transfer system. If a melter is not provided with an appropriate flow of hot melt adhesive pieces, the melter will not be able to provide liquid hot melt adhesive to a dispenser. This would cause an undesirable disruption of a dispensing operation.

In addition, as hot melt adhesive pieces begin to stick together in the adhesive supply, features can be formed in the adhesive supply that also tend to deprive an adhesive melter with an appropriate flow of hot melt adhesive pieces.

For example, hot melt adhesive pieces that have stuck together can create a clump or an even larger formation in the adhesive supply. Such a formation will not be moved out of the adhesive supply by the pneumatic transfer system. In addition, the formation is likely to block the flow of hot melt adhesive pieces from the adhesive supply to the transfer conduit that connects the adhesive supply with the melter. Moreover, clumps or large formations of hot melt adhesive tend to cause nearby hot melt adhesive pieces to stick to them, and this process can lead to substantially large formations in the adhesive supply.

There is a need, therefore, for adhesive supply systems that address one or more of the drawbacks discussed above.

SUMMARY

The present invention is directed to systems for storing unmelted hot melt adhesive material at temperature conditions where the hot melt adhesive material will not soften or stick together to form clumps. In particular, the present invention provides for cooled hot melt adhesive material storage systems and related methods. Some embodiments of the invention use air as a cooling medium, and other embodiments use liquid as a cooling medium. Advantageously, hot melt adhesive material stored in the cooled systems described herein will not exhibit any of the problems associated with hot melt adhesive material that has warmed to the point where it softens and sticks together. Particularly, the hot melt adhesive material will not form clumps that would interfere with the efficient movement of the hot melt adhesive material to from the cooled system to a melter device.

According to one embodiment of the invention, a cooled hot melt adhesive material storage system is provided and includes a bin configured for receiving and holding a supply of hot melt adhesive pieces. The bin includes an outlet configured for communicating hot melt adhesive pieces to a melter device configured for melting the hot melt adhesive pieces into a liquid hot melt adhesive material. The cooled hot melt adhesive material storage system further includes a cooling unit operatively coupled with the bin. The cooling unit is configured for cooling hot melt adhesive pieces in the bin.

According to another embodiment of the invention, a method is provided for adjusting the temperature of hot melt adhesive pieces situated in a bin. The bin is configured for receiving and holding a supply of hot melt adhesive pieces, and includes an outlet configured for communicating hot melt adhesive pieces to a melter device. The bin further includes a cooling medium inlet in communication with a cooling unit. The method includes directing a cooling medium from the cooling unit into the cooling medium inlet, and cooling the hot melt adhesive pieces in the bin.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
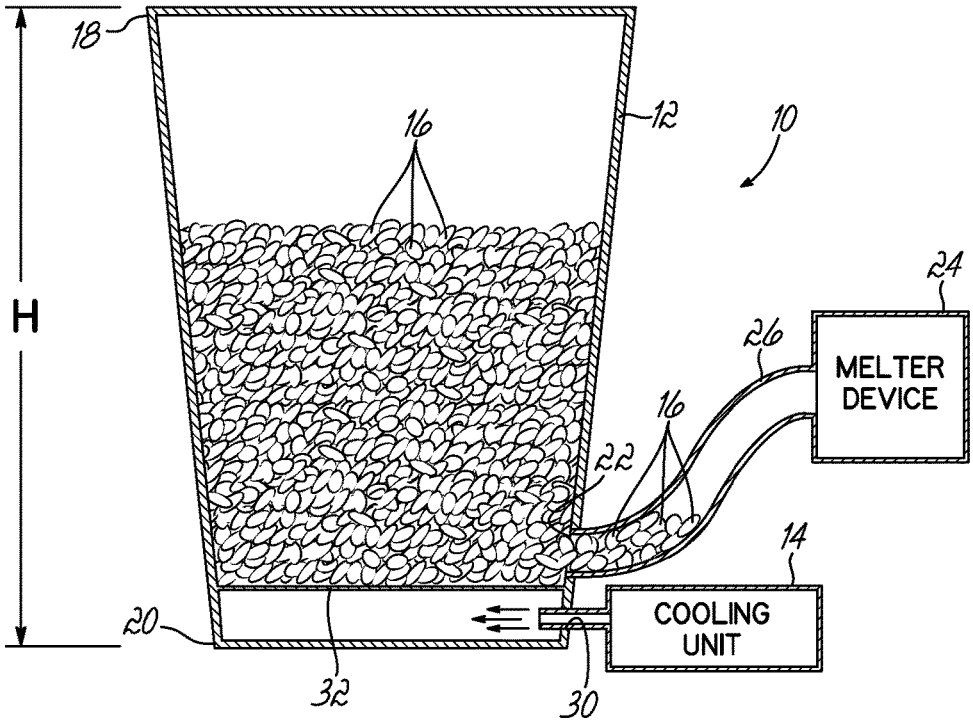
FIG. 1 is a schematic view depicting features of a cooled hot melt adhesive storage system according to a first embodiment of the invention.

Referring first to FIG. 1, a cooled hot melt adhesive material storage system 10 generally includes a bin 12 and a cooling unit 14. The bin 12 is configured to receive and hold a supply of hot melt adhesive pieces 16. The hot melt adhesive pieces 16 may have any appropriate shape or configuration. In the embodiment shown, the bin 12 is in the form of a container suitable for placement upon a floor surface or a tabletop, for example, and generally includes a top 18 and a bottom 20, and extends along a height H therebetween. Hot melt adhesive pieces 16 may be added to the bin 12, for example through the top 18. It will be appreciated that other types of bins could also be used in addition to what is shown.

The bin 12 also includes an outlet 22 that is configured for communicating hot melt adhesive pieces 16 to a melter device 24. The melter device 24 is configured to receive and melt the hot melt adhesive pieces 16 into a liquid hot melt adhesive material for a subsequent dispensing operation. As shown, a transfer conduit 26 is coupled with the outlet 22 for communicating hot melt adhesive pieces 16 to the melter device 24. For example, a pneumatic transfer system could be used to move the hot melt adhesive pieces 16 from the bin 12 through the transfer conduit 26 to the melter device 24.

The bin 12 also includes a cooling medium inlet 30. The cooling unit 14 is configured to provide a source of cooling medium through the cooling medium inlet 30 for cooling hot melt adhesive pieces 16 contained in the bin 12. In the embodiment shown, the cooling medium inlet 30 is positioned generally adjacent the outlet 22 of the bin 12. The cooling medium inlet 30 is also positioned generally adjacent the bottom 20 of the bin 12.

The cooling unit 14 is operatively coupled with the bin 12 for cooling hot melt adhesive pieces 16 therein. For the embodiment shown in FIG. 1, the cooling unit 14 is configured to provide cooling medium in the form of a gas. The gas is directed from the cooling unit 14 and through the cooling medium inlet 30 for direct contact with hot melt adhesive pieces 16 in the bin 12. The gas flows over and around the various hot melt adhesive pieces 16 in the bin 12, thereby cooling the hot melt adhesive pieces. Optionally, and as shown, the bin 12 can further include a grate 32 spaced from the bottom 20 and supporting the hot melt adhesive pieces 16 thereabove. The cooling medium inlet 30 is positioned near the bottom 20 so the gas can be provided into the bin 12 beneath the grate 32. Thereby, the gas is introduced beneath the hot melt adhesive pieces 16 and flows upwardly from near the bottom 20 toward the top 18 of the bin 12, cooling the hot melt adhesive pieces 16 along the way.

The cooling unit 14 can be configured to provide the gas to the bin 12 on any basis, including for example, intermittent, continual, or as-needed. Advantageously, the cooling unit 14 is configured to maintain the hot melt adhesive pieces 16 in the bin 12 at temperatures below about 40° C.

Optionally, the cooling unit 14 can also be configured to provide dry air for cooling and drying the hot melt adhesive pieces 16 in the bin 12. For example, the air provided by the cooling unit 14 can be characterized by a low dew point value, such as −40° C., for example.

The cooled hot melt adhesive material storage systems 10 can be used as part of a method for adjusting the temperature of hot melt adhesive pieces 16 in the bin 12. That method includes directing gas from the cooling unit 14 into the cooling medium inlet 30, and then cooling the hot melt adhesive pieces in the bin 12. In particular, the gas is directed through the cooling medium inlet 30 and into the bin 12 for direct contact with hot melt adhesive pieces 16 in the bin 12. If a grate 32 is included, the gas may be provided into the bin 12 beneath the grate 32. Advantageously, cooling of the hot melt adhesive pieces 16 is performed to maintain the hot melt adhesive pieces below about 40° C. Further still, the method may include directing hot melt adhesive pieces 16 from the outlet 22 of the bin 12 into the transfer conduit 26 for communicating the hot melt adhesive pieces 16 to the melter device 24.

Figure 2:
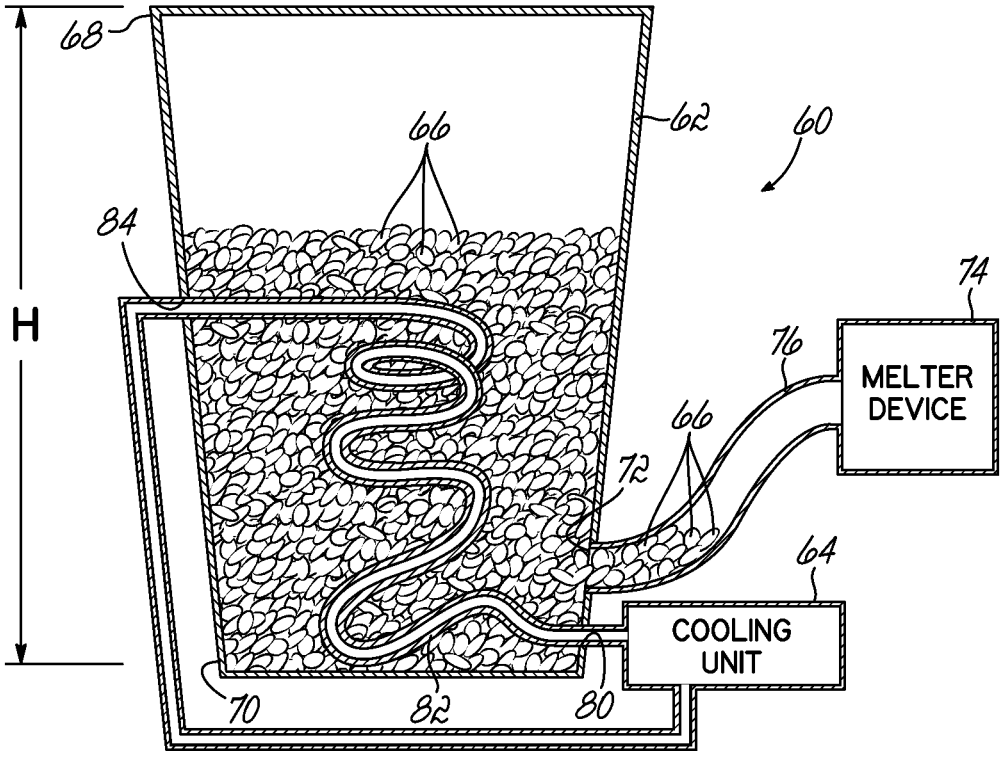
FIG. 2 is a schematic view depicting features of a cooled hot melt adhesive storage system according to a second first embodiment of the invention.

Referring next to FIG. 2, a cooled hot melt adhesive material storage system 60 generally includes a bin 62 and a cooling unit 64. The bin 62 is configured to receive and hold a supply of hot melt adhesive pieces 66, which like the hot melt adhesive pieces 16 may have any appropriate shape or configuration. The bin 62 is also in the form of a container that is suitable for placement upon a floor surface or a tabletop, and generally includes a top 68 and a bottom 70, and extends along a height H therebetween. Hot melt adhesive pieces 66 may be added to the bin 62, for example through the top 68. It will again be appreciated that other types of bins could also be used in addition to what is shown.

The bin 62 also includes an outlet 72 that is configured for communicating hot melt adhesive pieces 66 to a melter device 74. The melter device 74 is substantially similar to the melter device 24 discussed above. A transfer conduit 76 is coupled with the outlet 72 for communicating hot melt adhesive pieces 66 to the melter device 74. As discussed above, a pneumatic transfer system could be used to move the hot melt adhesive pieces 66 from the bin 62 through the transfer conduit 76 to the melter device 74.

The bin 62 also includes a cooling medium inlet 80. The cooling unit 64 is configured to provide a source of cooling medium through the cooling medium inlet 80 for cooling hot melt adhesive pieces 66 contained in the bin 62. In the embodiment shown, the cooling medium inlet 80 is positioned generally adjacent the outlet 72 of the bin 12. The cooling medium inlet 80 is also positioned generally adjacent the bottom 70 of the bin 62.

The cooling unit 64 is operatively coupled with the bin 62 for cooling hot melt adhesive pieces 66 therein. For the embodiment shown in FIG. 2, the cooling unit 64 is configured to provide cooling medium in the form of a liquid. The liquid is directed from the cooling unit 64 and through the cooling medium inlet 80 and into a cooling medium conduit 82 positioned in the bin 62. The cooling medium conduit 82 is coupled with the cooling medium inlet 80 so as to receive liquid from the cooling unit 64. Hot melt adhesive pieces 66 in the bin 62 are cooled by indirect contact with the liquid through the cooling medium conduit 82. As shown, the cooling medium conduit 82 has a generally coiled configuration and extends substantially along the height H of the bin 62. Thereby, the cooling effect of the cooling medium conduit 82 is imparted throughout all or at least a great portion of the hot melt adhesive pieces 66. As hot melt adhesive pieces 66 move in the bin 62 as hot melt adhesive pieces 66 below them are directed to the melter device 74, the hot melt adhesive pieces 66 move over, around, and near the cooling medium conduit 82. The hot melt adhesive pieces 66 are cooled by the cooling medium conduit 82. As shown, the bin 62 also includes a cooling medium outlet 84. The cooling medium outlet 84 is coupled with the cooling medium conduit 82 and communicates with the cooling unit 64 for directing liquid from the cooling medium conduit 82 back to the cooling unit 64.

The cooling unit 64 can be configured to provide the liquid to the cooling medium conduit 82 in the bin 62 on any basis, including for example, intermittent, continual, or as-needed. Advantageously, the cooling unit 64 is configured to maintain the hot melt adhesive pieces 66 in the bin 62 at temperatures below about 40° C.

The cooled hot melt adhesive material storage systems 60 can be used as part of a method for adjusting the temperature of hot melt adhesive pieces 66 in the bin 62. That method includes directing the liquid from the cooling unit 64 into the cooling medium inlet 80, and then cooling the hot melt adhesive pieces in the bin 62. In particular, the liquid is directed through the cooling medium inlet 80 and into the cooling medium conduit 82 such that hot melt adhesive pieces 66 in the bin 62 are cooled by indirect contact with the liquid through the cooling medium conduit 82. Advantageously, the liquid is directed through the cooling medium conduit 82 substantially along the height H of the bin 62. The method may further include directing the liquid from the cooling medium conduit 82 back to the cooling unit 64. Advantageously, cooling of the hot melt adhesive pieces 66 is performed to maintain the hot melt adhesive pieces below about 40° C. Further still, the method may include directing hot melt adhesive pieces 66 from the outlet 72 of the bin 62 into the transfer conduit 76 for communicating the hot melt adhesive pieces 66 to the melter device 74.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A cooled hot melt adhesive material storage system, comprising:

a bin configured for receiving and holding a supply of hot melt adhesive pieces, the bin having a bottom surface and a first side surface extending from the bottom surface, the bin including an outlet configured for communicating hot melt adhesive pieces to a melter device configured for melting the hot melt adhesive pieces into a liquid hot melt adhesive material, and a cooler operatively coupled with the bin at a cooling medium inlet on the first side surface, the cooler configured to direct a cooling medium through the cooling medium inlet into the bin for cooling hot melt adhesive pieces in the bin.

2. The system of claim 1, cooler being configured to maintain the hot melt adhesive pieces in the bin at temperatures below about 40° C.

3. The system of claim 1, further comprising a transfer conduit coupled with the outlet of the bin and further configured for communicating hot melt adhesive pieces to the melter device.

4. The system of claim 1, wherein the cooling medium is a gas, and the cooling medium inlet receives the gas directly into the bin for direct contact with hot melt adhesive pieces therein.

5. The system of claim 4, the cooling medium inlet being positioned adjacent the outlet of the bin.

6. The system of claim 4, the cooling medium inlet being positioned adjacent the bottom surface of the bin.

7. The system of claim 6, wherein the bin further includes a grate spaced from the bottom surface and the hot melt adhesive pieces are supported above the grate, and the cooling medium inlet is positioned to provide the gas into the bin beneath the grate.

8. The system of claim 4, wherein the gas has a dew point value of about −40° C.

9. The system of claim 1, wherein the cooling medium is a liquid, and further comprising a cooling medium conduit positioned in the bin and coupled with the cooling medium inlet, the cooler pumping the liquid through the cooling medium conduit such that hot melt adhesive pieces in the bin are cooled by indirect contact with the liquid through the cooling medium conduit.

10. The system of claim 9, wherein the cooling medium conduit has a coiled configuration.

11. The system of claim 9, wherein the bin has a height and the cooling medium conduit extends substantially along the height.

12. The system of claim 9, wherein the bin further comprises a cooling medium outlet coupled with the cooling medium conduit and in communication with the cooler for directing liquid from the cooling medium conduit back to the cooler.

13. The system of claim 1, wherein the first side surface is substantially perpendicular to the bottom surface.

14. The system of claim 1, wherein the first side surface extends along a height of the bin.

15. A method for cooling hot melt adhesive pieces in a bin having a bottom surface and a first side surface extending from the bottom surface, the bin being configured for receiving and holding a supply of hot melt adhesive pieces, and including an outlet configured for communicating hot melt adhesive pieces to a melter device and including a cooling medium inlet on the first side surface, the method comprising:

directing a cooling medium from a cooler into the bin through the cooling medium inlet to cool the hot melt adhesive pieces in the bin.

16. The method of claim 15, wherein cooling the hot melt adhesive pieces in the bin comprises maintaining the hot melt adhesive pieces at temperatures below about 40° C.

17. The method of claim 15, further comprising directing hot melt adhesive pieces from the outlet of the bin and into a transfer conduit coupled with a melter device configured for melting the hot melt adhesive pieces into a liquid hot melt adhesive material.

18. The method of claim 15, wherein the cooling medium is a gas, and further comprising providing the gas directly into the bin through the cooling medium inlet for direct contact with hot melt adhesive pieces therein.

19. The method of claim 18, wherein the bin further includes a grate positioned near a bottom thereof and the hot melt adhesive pieces are supported above the grate, and wherein providing the gas is performed beneath the grate.

20. The method of claim 18, wherein the gas has a dew point value of about −40° C.

21. The method of claim 15, wherein the cooling medium is a liquid, and further comprising directing the liquid into a cooling medium conduit positioned in the bin such that hot melt adhesive pieces in the bin are cooled by indirect contact with the liquid through the cooling medium conduit.

22. The method of claim 21, wherein the bin has a height and directing the liquid includes directing the liquid substantially along the height of the bin.

23. The method of claim 21, further comprising directing the liquid from the cooling medium conduit back to the cooler.

* * * * *